United States Patent [19]

Sugizaki et al.

[11] Patent Number: 4,580,890

[45] Date of Patent: Apr. 8, 1986

[54] PAPER FEEDING SYSTEM IN A COPYING APPARATUS

[75] Inventors: Tsugio Sugizaki; Tadashi Abe, both of Hachioji, Japan

[73] Assignee: Konishiroku Photo Industry Co., Ltd., Tokyo, Japan

[21] Appl. No.: 500,617

[22] Filed: Jun. 3, 1983

[30] Foreign Application Priority Data

Jun. 10, 1982 [JP] Japan ..... 57-99807

[51] Int. Cl.[4] ..... G03G 15/00

[52] U.S. Cl. ..... 355/14 SH; 355/3 SH; 271/162

[58] Field of Search ..... 271/162, 164; 355/3 SH, 355/14 SH

[56] References Cited

U.S. PATENT DOCUMENTS

| | | | |
|---|---|---|---|
| 4,165,069 | 8/1979 | Colglazier et al. | 271/162 |
| 4,190,354 | 2/1980 | Smith et al. | 355/3 SH |
| 4,417,806 | 11/1983 | Tami et al. | 355/14 SH |
| 4,422,751 | 12/1983 | Komiya et al. | 355/14 SH |

*Primary Examiner*—R. L. Moses
*Assistant Examiner*—David Warren
*Attorney, Agent, or Firm*—Jordan B. Bierman

[57] ABSTRACT

A paper feeding system for a copying apparatus has an auxiliary paper feeding unit which feeds paper to a photocopying member over a longer path than that of a primary paper feeding unit. The paper feeding system is provided with a drawing-out roller for feeding paper from the auxiliary unit to a stand-by position which is provided with a pair of auxiliary paper feeding rollers, for feeding paper from the stand-by position into the copying apparatus, and a detector for detecting paper at the stand-by position. When no paper is detected at the stand-by position, a signal is provided to the drawing-out roller to feed another paper from the auxiliary unit to the stand-by position. The stand-by position is selected so that the length of the paper feeding path from the stand-by position to the photocopying member is about equal to the path from the primary paper feeding unit.

8 Claims, 7 Drawing Figures

PAPER FEEDING SYSTEM IN A COPYING APPARATUS

BACKGROUND OF THE INVENTION

1. Field of the Invention

The invention relates to improvements in a copying apparatus having adaptor type paper feeding units which augment the paper feeding capability of the copying apparatus, if occasion demands.

2. Description of the Prior Art

In recent year, there have been proposed adaptor type paper feeding units capable of augmenting copying capability in the case of a large amount of copies or the like. In the drawings, namely, FIG. 1 illustrates a copying apparatus having such a detachable paper feeding unit A as has been proposed. In this type of copying apparatus, other additional paper feeding units A may be attached, if required, to the lower part of copying apparatus B being thereto provided with two sets of paper feed tables 2A, 2B each capable of loading paper feed cassettes 1A, 1B, respectively. More detailedly, in this type of copying apparatus, recording paper inlet 5 is provided at the bottom of copying apparatus B so that recording papers X may be fed in from paper feeding unit A at the midpoint of paper feeding passages 4 from the aforementioned paper feed tables 2A, 2B respectively to photoreceptor drum 3. Accordingly, recording paper X having been stored in recording paper cassette 1C is fed in as occasion demands to paper feeding passage 4 of copying apparatus B by the action of paper drawing-out roller 6 located above paper feed table 2C for paper feeding unit A.

In such a copying apparatus constituted as mentioned above, however, there is a problem that the distance along the paper feeding passage from paper feed table 2C extended over to photoreceptor drum 3, that is, namely, paper feed path $L_2$ in paper feeding unit A, becomes much longer than the distances along the paper feeding passage from paper feed table 2A, 2B respectively to photoreceptor drum 3, that is, namely, paper feed path $L_1$. Resultantly, in the conventional types of copying apparatuses, there is a problem of paper feeding speeds when using paper feeding unit A, that is, that recording paper may not be fed unless the timing of paper feeding is slower than that of paper feeding by means of paper feed table 2C. Therefore, the lowering of the copying speeds of copying apparatuses have been unavoidable when paper feeding unit A has been used therewith.

FIG. 5 is a time-chart showing the abovementioned relation to be originated when a continuous copying is operated. FIG. 5(1) is a time-chart for a copying apparatus being provided with paper feeding tables 2A, 2B only, and which shows the operation of primary paper feeding roller $R_1$ provided on paper feeding tables 2A, 2B; the operation of secondary paper feeding roller $R_2$, that is also called a registration roller, for feeding paper-sheets synchronously with the revolution of an electrophotosensitive receptor drum; and the operation of recording paper detecting sensor $S_0$ provided immediately before the secondary paper feeding roller $R_2$; with demand signal OD generated from the copying apparatus to revolve the secondary paper feeding roller $R_2$.

FIG. 5(2) is a time-chart for the conventional type of copying apparatus having an added paper feeding table 2C, and this time chart shows the operation of paper drawing out roller 6 located on the upper part of paper feeding table 2C; the operation of the aforementioned secondary paper feeding roller $R_2$; and the operation of the aforementioned recording paper detecting sensor $S_0$; with the aforementioned demand signal OD. In comparison with the case of FIG. 5(1), the number of copied papers per unit of time will decrease in this case.

OBJECTS AND SUMMARY OF THE INVENTION

With the purpose of improving the copying speeds of such a copying apparatus as mentioned above, it is an object of the invention to propose a copying apparatus capable of making copies at a paper feeding speed equivalent to those of the paper feed tables which are inside of a copying apparatus even in the case of using added paper feeding units.

The invention is embodied in a paper feeding system of a copying apparatus, comprising a paper feeding unit that is, if occasion demands, attachable to the apparatus and capable of feeding recording paper sheets into the apparatus at the midway of the paper feeding passage of the apparatus; paper feeding rollers revolvable by giving thereto a paper feeding demand signal from the apparatus provided immediately before the paper inlet of the paper feeding passage; and a detector capable of detecting the leading end of the recording paper located immediately before the paper feeding rollers so that a paper drawing out means inside the paper feeding unit may be controlled by the signals given from the detector.

BRIEF DESCRIPTION OF THE DRAWINGS

FIG. 5(1) is a time-chart of the operation of a copying apparatus provided with paper feeding units 2A, 2B only;

FIG. 5(2) is a time-chart of the operation of a conventional type copying apparatus having an added paper feeding unit 2C; and FIG. 5(3) is a time-chart of the operation of a copying apparatus relating to the invention and in which paper feeding unit 2C is added.

DESCRIPTION OF THE PREFERRED EMBODIMENTS

Figure 1:
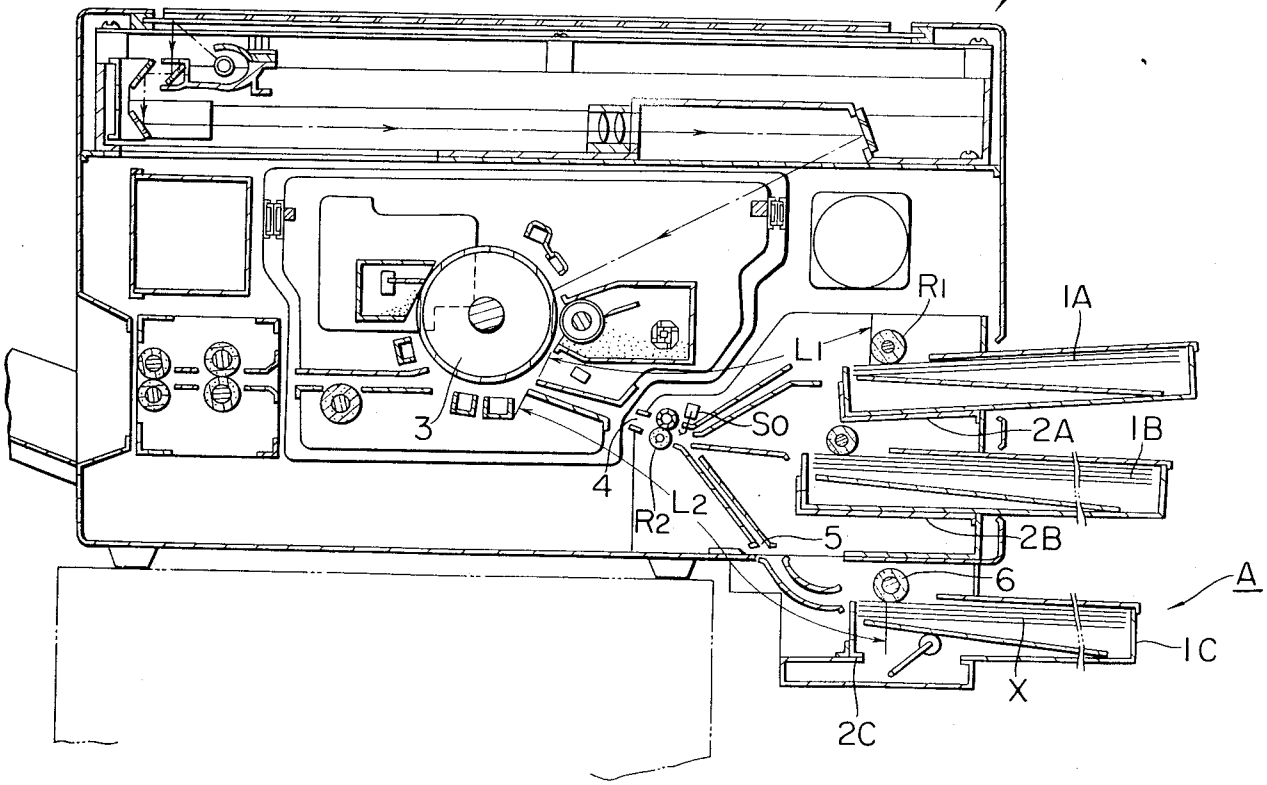
FIG. 1 is a cross-sectional view of a copying apparatus having an additional paper feeding unit A.
Figure 2:
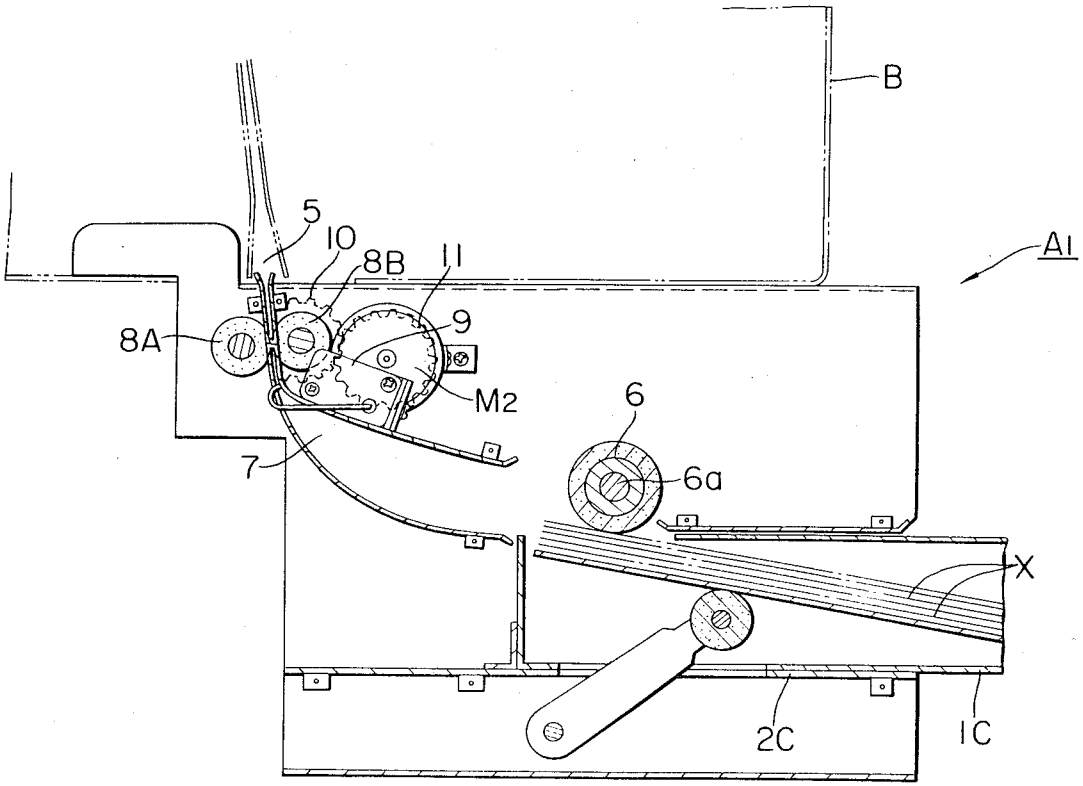
FIG. 2 is a cross-sectional view of a paper feeding unit which is to be employed in the invention.
Figure 3:
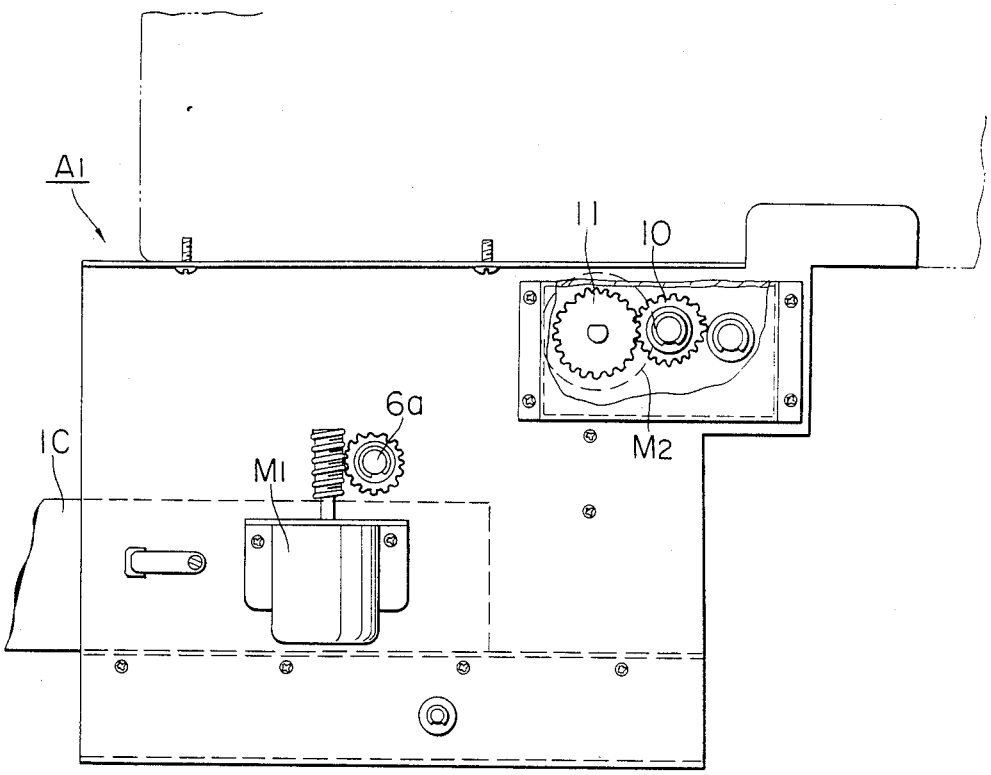
FIG. 3 is a side view of the paper feeding unit thereof.
Figure 4:
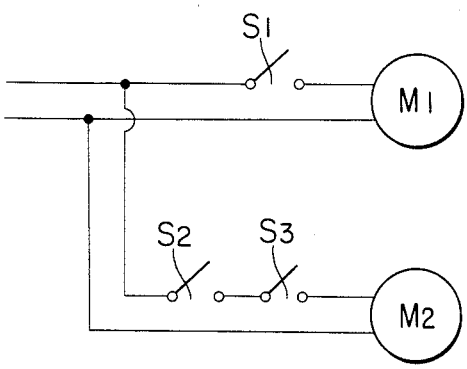
FIG. 4 is an electric circuit diagram of the paper feeding unit thereof.

The following is the detailed description of the examples of the invention with reference to FIG. 2 through FIG. 4:

FIG. 2 is a cross-sectional view showing paper feeding unit $A_1$ being used in a copying apparatus of the invention, wherein the structural parts like or corresponding to those shown in FIG. 1 are designated by like reference characters or like reference numerals designated in FIG. 1.

The invention is characterized in a pair of paper feeding rollers 8A, 8B each incorporated in auxiliary paper feeding passage 7 from paper feed table 2C in paper feeding unit $A_1$ to paper inlet 5, and also in microswitch 9 that is a detector positioned immediately before paper feeding rollers 8A, 8B and used for detecting the leading end of recording paper X. In other words, as shown in FIG. 3, driven gear 10 is fixed to one shaft-end of paper feeding roller 8B and is then engaged with driving gear 11 of driving motor $M_2$ being regulated by a paper feeding demand signal given from copying apparatus B, and on the other hand, driving motor $M_1$ revolving shaft 6*a* of aforementioned paper drawing-out roller 6 is regulated by a signal given from abovementioned microswitch 9. For this purpose, switch $S_1$ is incorporated as shown in FIG. 4 into the driving circuit of driving motor $M_1$ so as to make it be closed by the paper feeding demand signal which is given from micro-switch 9 when the switch does not detect recording paper. In the driving circuit of driving motor $M_2$, there are incorporated selective switch $S_2$ to be closed by a demand for using a paper feeding unit in copying apparatus B and paper drawing-out demand switch $S_3$ to be closed when said sensor So detects the following end of recording paper fed by secondary paper feeding roller $R_2$ and the abovementioned microswitch 9 detects the leading end of recording paper X. After passing through paper feeding rollers 8, recording paper X moves to a paper transferring position adjacent secondary paper feeding roller $R_2$ and upstream thereof.

Because of such a constitution of the apparatus of this example, only one sheet of recording papers X is drawn out from recording paper cassette 1C according to a demand of microswitch 9 when any recording paper X is not on auxiliary paper feeding passage 7, and the very recording paper sheet X will be on standby immediately before paper feeding rollers 8A, 8B at the moment when driving motor $M_1$ is stopped in motion by the action of microswitch 9. Accordingly, when a demand signal for using a paper feeding unit is given once from copying apparatus B, paper feeding rollers 8A, 8B, are started to revolve and the recording paper X on standby is fed into paper inlet 5 at once. When microswitch 9 does not detect recording paper X, paper drawing-out roller 6 is then resumed to revolve and the next recording paper X is fed on standby in auxiliary paper feeding passage 7.

Figure 5:
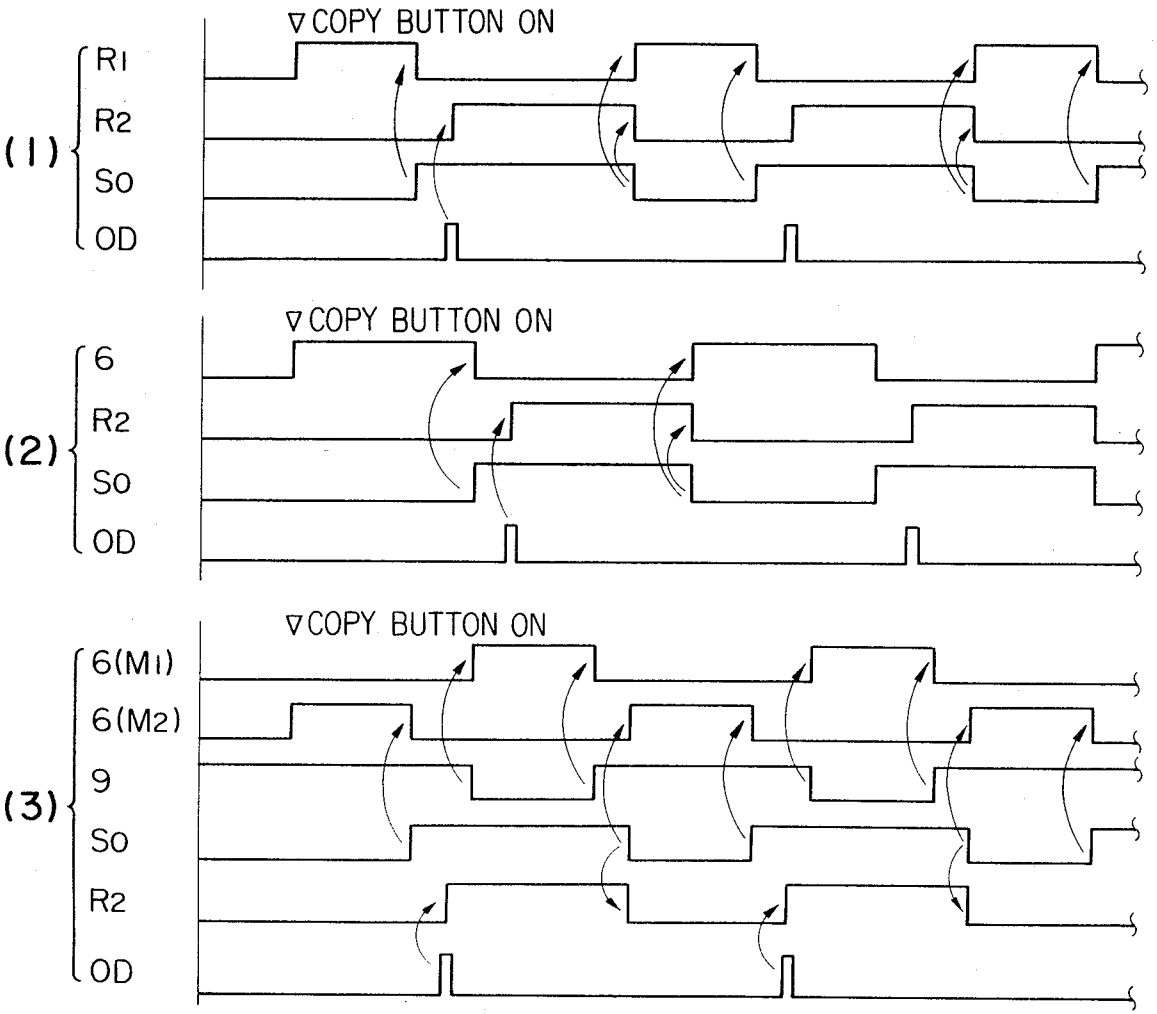
FIG. 5 is a time-chart illustrating the case of a continuous copying operation.

In FIG. 5(3), illustrating a time-chart of the operation of a copying apparatus relating to the invention to which paper feeding unit 2C is added, there are shown the relations of the abovementioned demand signal OD with the respective operations of paper drawing out roller 6 driven by abovementioned driving motor $M_1$; of paper feeding roller 8 driven by abovementioned driving motor $M_2$; of abovementioned intermediate microswitch 9; of abovementioned sensor $S_0$; and of the abovementioned secondary paper feeding roller $R_2$. In the time-charts, each of the axes of time, i.e., the axes of abscissas is calibrated similar to those of FIGS. 5(1) and 5(2).

In accordance with the invention, it is therefore possible to achieve a substantial improvement on a copying capability by accelerating the copying speed even when using added paper feeding units, because paper feeding path $L_2$ in paper feeding unit $A_1$ may be made equivalent to paper feeding path $L_1$ in the copying apparatus by feeding paper to the stand-by position of paper feeding rollers 8A, 8B in auxiliary paper feeding passage 7.

We claim:

1. A paper feeding system for a copying apparatus comprising:

(a) at least two paper feeding units and means defining two respective paper feeding passages, one from each paper feeding unit, to a paper transferring position of said copying apparatus which are of different lengths from each other, said paper transferring position being between one of said units and a toner image transfer station;

(b) drawing-out means for feeding paper from one of said paper feeding units over a longer one of said paper feeding passages to a stand-by position, said stand-by position being between one of said units and said paper transferring position;

(c) a pair of paper feeding rollers provided at said stand-by position of said longer passage which is actuated in response to a paper feeding demand signal provided by said copying apparatus; and (d) a detector for detecting paper at said stand-by position, said detector being adapted to provide a signal upon detection of the existence of paper at said stand-by position to inactivate said drawing-out means so as to maintain a paper at said stand-by position.

2. A paper feeding system as described in claim 1, wherein said one paper feeding unit is attachable to said copying apparatus and forms part of said longer passage, and said pair of paper feeding rollers and said detector are provided in said one paper feeding unit.

3. A paper feeding system as described in claim 1, wherein said stand-by position is located such that the length of the paper feeding path from said stand-by position to said photocopying member is made approximately equivalent to the length of the shorter one of said paper feeding passages.

4. A paper feeding system as described in claim 1, wherein said detector is adapted to provide a further signal upon detection of the absence of paper at said stand-by position to activate said drawing-out means so as to feed paper to said stand-by position.

5. A paper feeding apparatus of a copying machine for feeding paper from a stack to a pair of registration rollers which further feeds the paper to a toner image transfer station, said pair of rollers being between said stack and said toner image transfer station, said apparatus comprising drawing-out means for feeding paper from said stack; means defining a paper feeding passage extending between said stack and said pair of rollers; stand-by paper feeding means located at a stand-by position of said paper feeding passage between said stack and said pair of rollers, first detecting means located at said stand-by position for detecting paper fed from said drawing-out means; and second detecting means located at said pair of rollers for detecting paper fed from said stand-by paper feeding means, wherein said drawing-out means is controlled in accordance with a signal from said first detecting means, and said stand-by paper feeding means is controlled in accordance with a signal of said second detecting means.

6. The paper feeding apparatus of claim 5, wherein said drawing-out means is energized in response to the signal of said first detecting means indicating the absence of paper at said stand-by position, and de-energized in response to the signal of said first detecting means indicating that a leading edge of a paper is detected at said stand-by position.

7. The paper feeding apparatus of claim 5, wherein said stand-by paper feeding means is energized in response to both an output signal indicating that the following edge of a paper is detected by said second detecting means and an output signal of said first detecting means indicating that a paper is present at said stand-by position, and de-energized in response to an output signal indicating that a leading edge of a paper is detected by said second detecting means.

8. The paper feeding apparatus of claim 5, wherein said stack, drawing-out means, stand-by paper feeding means, first detecting means, and a part of said paper feeding passage are formed together as a unit which is attachable to the copying machine.

* * * * *